US012178272B2

(12) United States Patent
Heimlich

(10) Patent No.: US 12,178,272 B2
(45) Date of Patent: Dec. 31, 2024

(54) BUTTON APPARATUS FOR CLOTHING

(71) Applicant: Simy Heimlich, Brooklyn, NY (US)

(72) Inventor: Simy Heimlich, Brooklyn, NY (US)

( * ) Notice: Subject to any disclaimer, the term of this patent is extended or adjusted under 35 U.S.C. 154(b) by 9 days.

(21) Appl. No.: 17/750,348

(22) Filed: May 22, 2022

(65) Prior Publication Data

US 2022/0279884 A1 Sep. 8, 2022

Related U.S. Application Data

(63) Continuation-in-part of application No. 17/170,952, filed on Feb. 9, 2021, now abandoned.

(60) Provisional application No. 62/975,771, filed on Feb. 13, 2020.

(51) Int. Cl.
*A44B 1/18* (2006.01)
*A41H 37/10* (2006.01)

(52) U.S. Cl.
CPC ..... *A41H 37/10* (2013.01); *A44B 1/18* (2013.01)

(58) Field of Classification Search
CPC ..... A44B 1/38; A44B 1/185; A44B 1/18; A44B 1/104; A41H 37/005; Y10T 24/3689
See application file for complete search history.

(56) References Cited

U.S. PATENT DOCUMENTS 1,581,299 A * 4/1926 Shiba ..... A44B 1/185 24/105
2,104,885 A * 1/1938 Robbins ..... A44B 1/28 24/690
2,605,943 A * 8/1952 Hoefle ..... D05B 85/00 223/102
2,640,238 A * 6/1953 Schuhr ..... A44B 1/12 24/113 R
3,087,215 A * 4/1963 Tworek ..... A44B 1/08 24/114.9
3,349,447 A * 10/1967 Raleigh, Jr. ..... A44B 1/185 24/114.7
3,754,304 A * 8/1973 Modrey ..... A44B 1/185 24/114.7
3,785,009 A * 1/1974 Nysten ..... A44B 1/185 24/114.7
4,063,312 A * 12/1977 Braillard ..... A44B 1/185 2/265
4,232,427 A * 11/1980 Mawhinney ..... A44B 1/185 24/103
4,480,357 A * 11/1984 Cummins ..... A44B 1/185 24/16 PB
4,793,155 A * 12/1988 Law ..... A44C 17/0216 63/29.1
D337,967 S * 8/1993 Wright ..... D11/222
2015/0208767 A1* 7/2015 Shafer ..... B29C 45/0001 264/299

* cited by examiner

*Primary Examiner* — Robert Sandy
*Assistant Examiner* — Rowland Do
(74) *Attorney, Agent, or Firm* — AlphaPatent Associates Ltd.; Daniel J. Swirsky

(57) ABSTRACT

A fabric buttoning apparatus, including a plate, a needle, and a string, a first end thereof being fixed to the plate, and a second end thereof being fixed to the wide end of the needle, and a slit crossing from side to side of the plate.

2 Claims, 14 Drawing Sheets

BUTTON APPARATUS FOR CLOTHING

CROSS-REFERENCE TO RELATED APPLICATIONS

This application is a Continuation-in-Part of U.S. patent application Ser. No. 17/170,952, filed Feb. 9, 2021, which claims the benefit of priority from U.S. Provisional Patent Application No. 62/975,771, filed Feb. 13, 2020, the disclosures of which are incorporated herein by reference.

TECHNICAL FIELD

The invention relates to the field of buttons for clothes.

BACKGROUND

Sewing a button to a fabric upon falling of the original button is a complicated procedure.

U.S. Pat. No. 4,063,312 to Braillard discloses an apparatus for accompanying attaching a button to a garment. However, a typical situation is that the button is missing.

Further, Braillard's apparatus discloses disposing the apparatus between the garment and the button, thus disposing the button away from the garment, differently viewed from the other buttons disposed attached to the garment.

There is a long felt need to provide a solution to the above-mentioned and other problems of the prior art.

SUMMARY

A buttoning apparatus for fabric, including a plate, a needle, and a string.

BRIEF DESCRIPTION OF THE DRAWINGS

Embodiments, features, and aspects of the invention are described herein in conjunction with the following drawings in which.

The drawings are not necessarily drawn to scale.

DETAILED DESCRIPTION

The invention will be understood from the following detailed description of embodiments of the invention, which are meant to be descriptive and not limiting. For the sake of brevity, some well-known features are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 1:
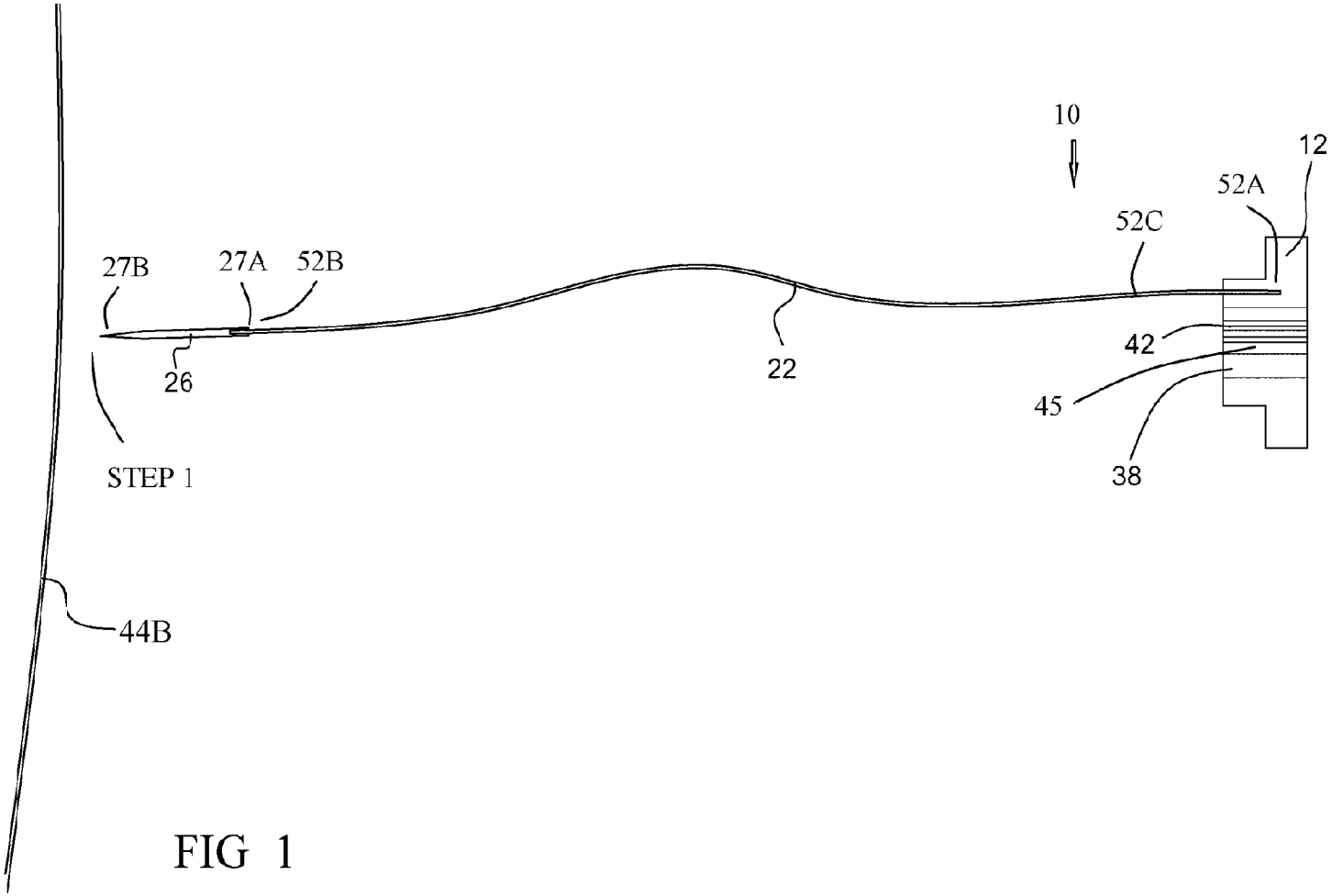
FIG. 1 is a side view of a buttoning apparatus for fabric according to one embodiment of the invention, at the first step of use.

FIG. 1 is a side view of a buttoning apparatus for fabric according to one embodiment of the invention, at the first step of use.

A buttoning apparatus 10 according to one embodiment, includes a plate 12, a needle 26; and a string 22, whose first end 52A is fixed to plate 12 whose second end 52B is fixed to needle 26. Thus, plate 12, string 22, and needle 26, fixed one to the other, constitute together an integrated object.

At the first step, the user disposes needle 26 near fabric 44B.

Figure 2:
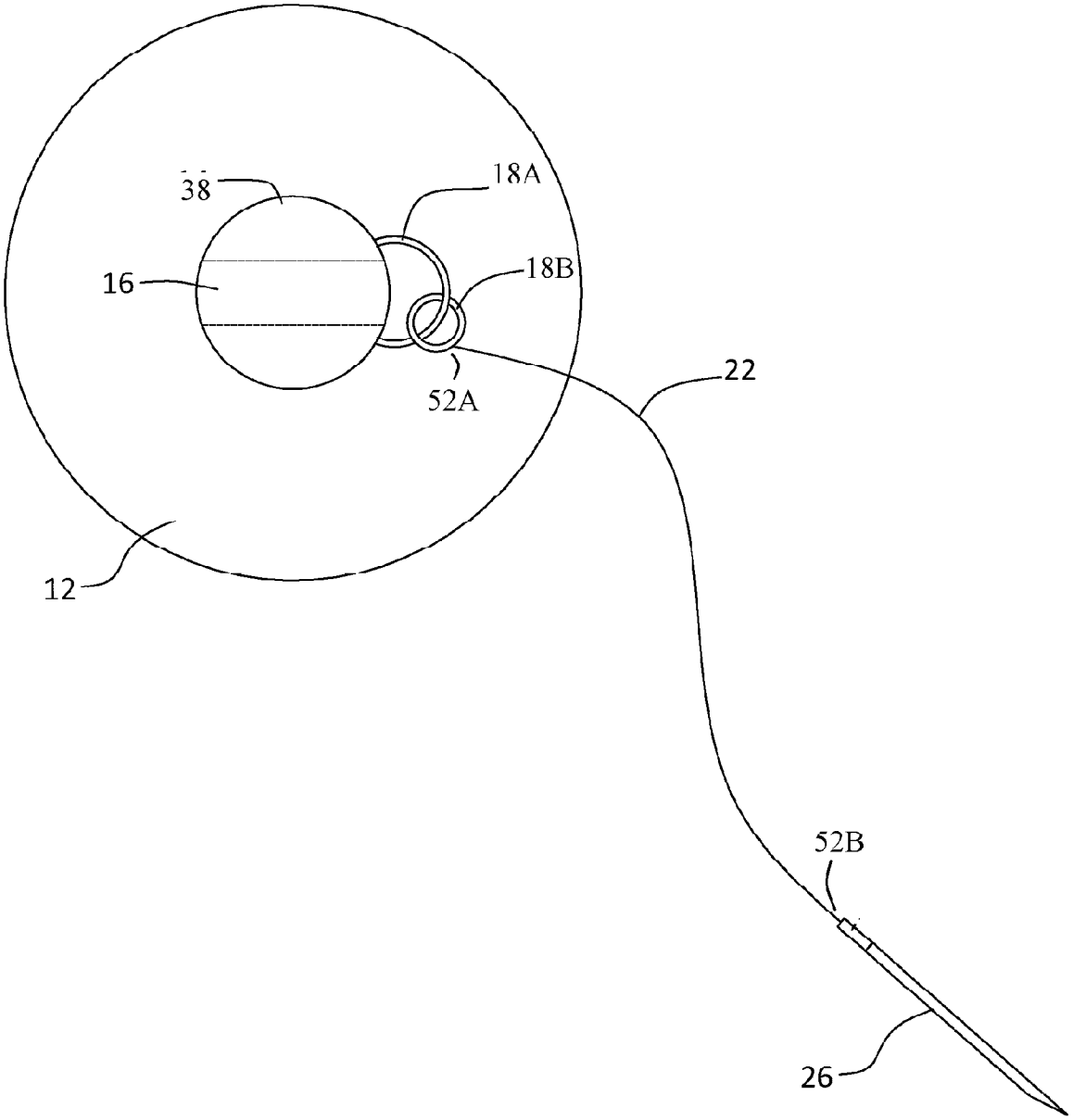
FIG. 2 is a front view of the buttoning apparatus of FIG. 1.

FIG. 2 is a front view of the buttoning apparatus of FIG. 1.

Plate 12 includes a closed hole 38.

Figure 3:
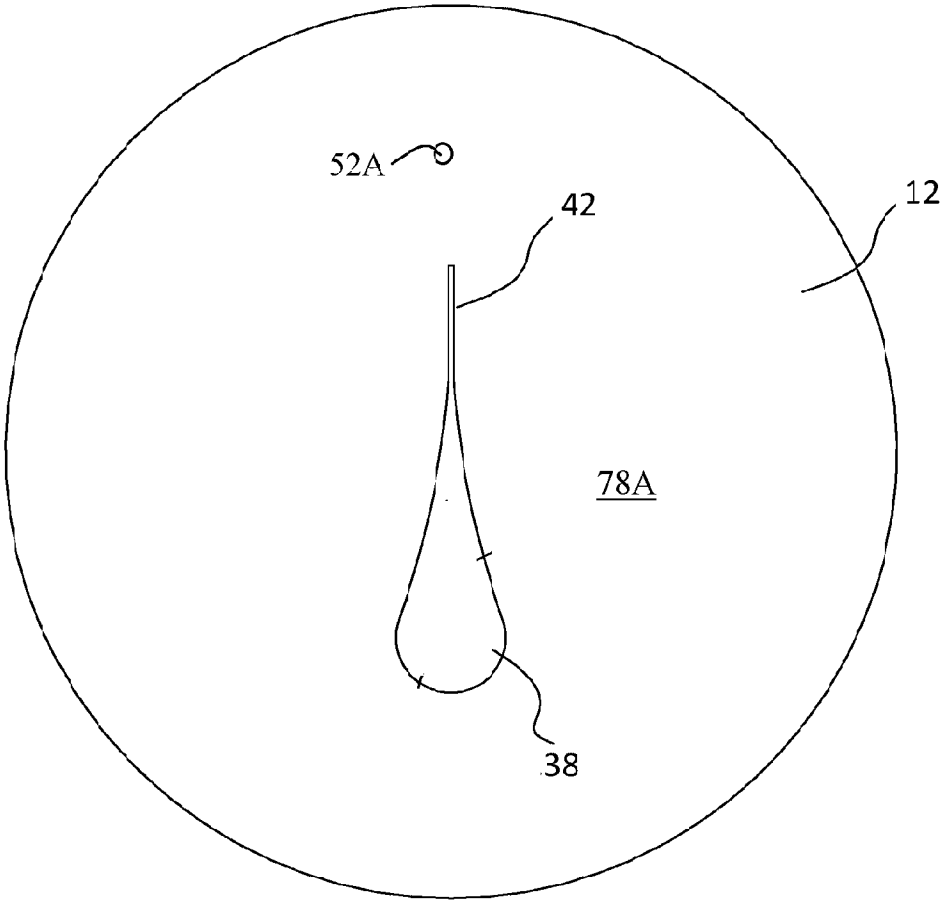
FIG. 3 is the front view of the buttoning apparatus of FIG. 1.

FIG. 3 is the front view of the buttoning apparatus of FIG. 1.

Hole 38 includes a narrowing towards a slit 42.

Figure 4:
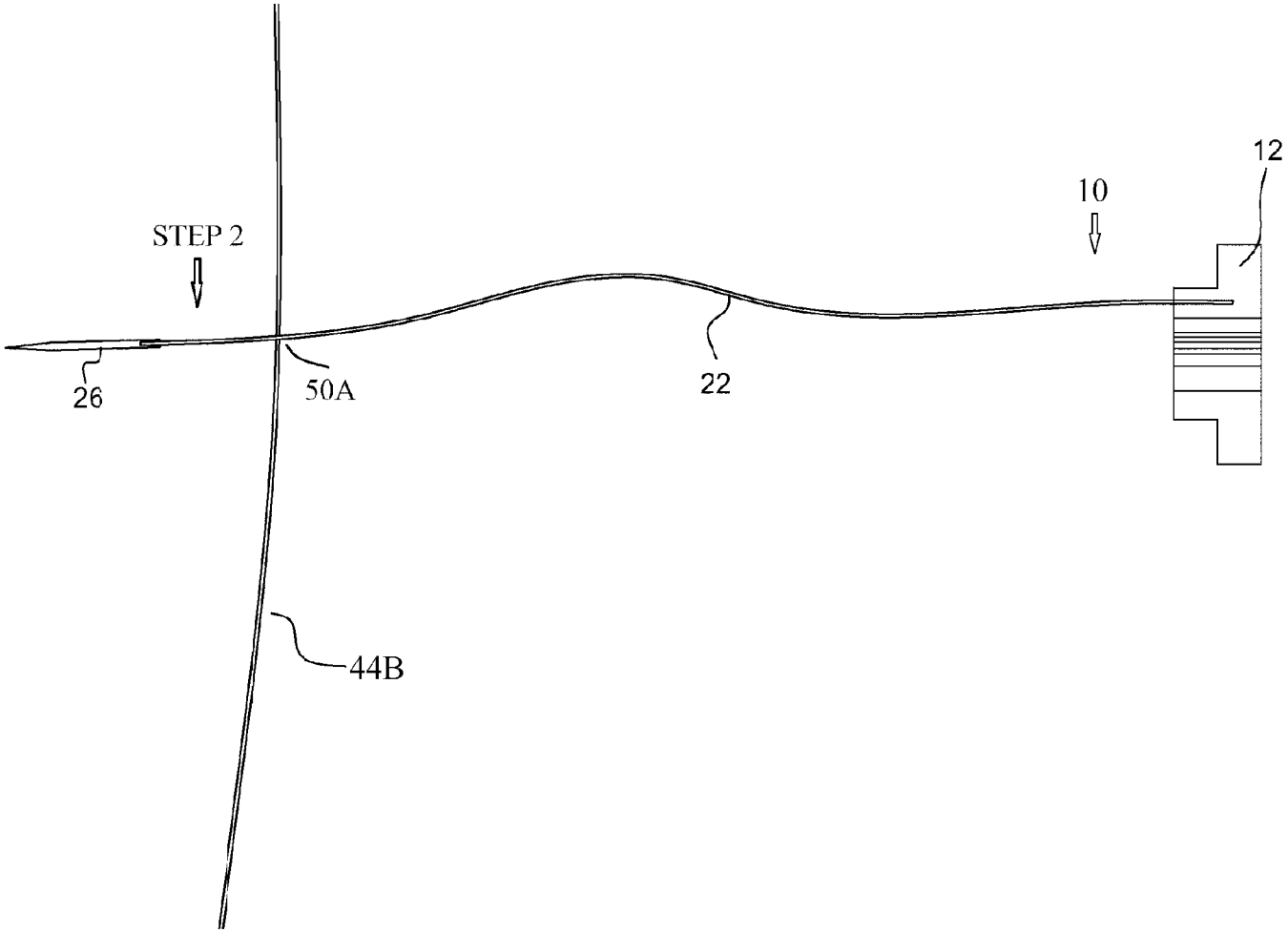
FIG. 4 depicts the second step of using the buttoning apparatus of FIG. 1.

FIG. 4 depicts the second step of using the buttoning apparatus of FIG. 1.

At the second step, the user threads needle 26 together with string 22 through a point 50A of fabric 44B.

Figure 5:
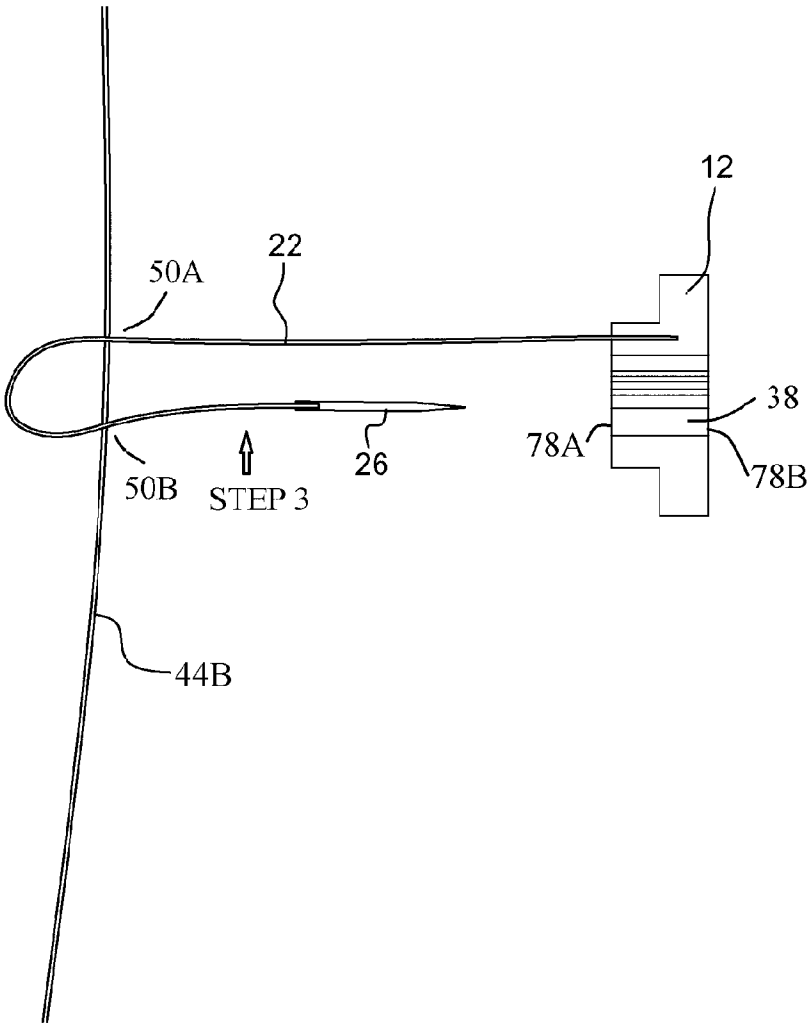
FIG. 5 depicts the third step of using the buttoning apparatus of FIG. 1.

FIG. 5 depicts the third step of using the buttoning apparatus of FIG. 1.

Closed hole 38 and slit 78A (FIG. 3) cross from side 78A of plate 12 to side 78B.

At the third step, the user threads needle 26 together with string 22 back through a point 50B of fabric 44B.

Figure 6:
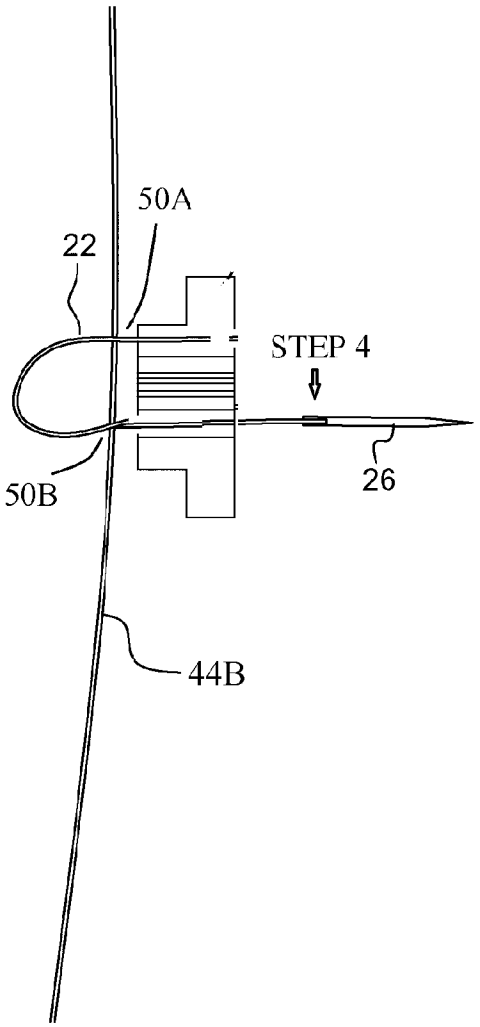
FIG. 6 is the side view at the fourth step of using the buttoning apparatus of FIG. 1.

FIG. 6 is the side view at the fourth step of using the buttoning apparatus of FIG. 1.

At the fourth step, the user threads needle 26 together with string 22 through hole 38 of plate 12.

String 22 preferably is soft and strong, and configured to be threaded easily through all types of fabric buttons.

Figure 7:
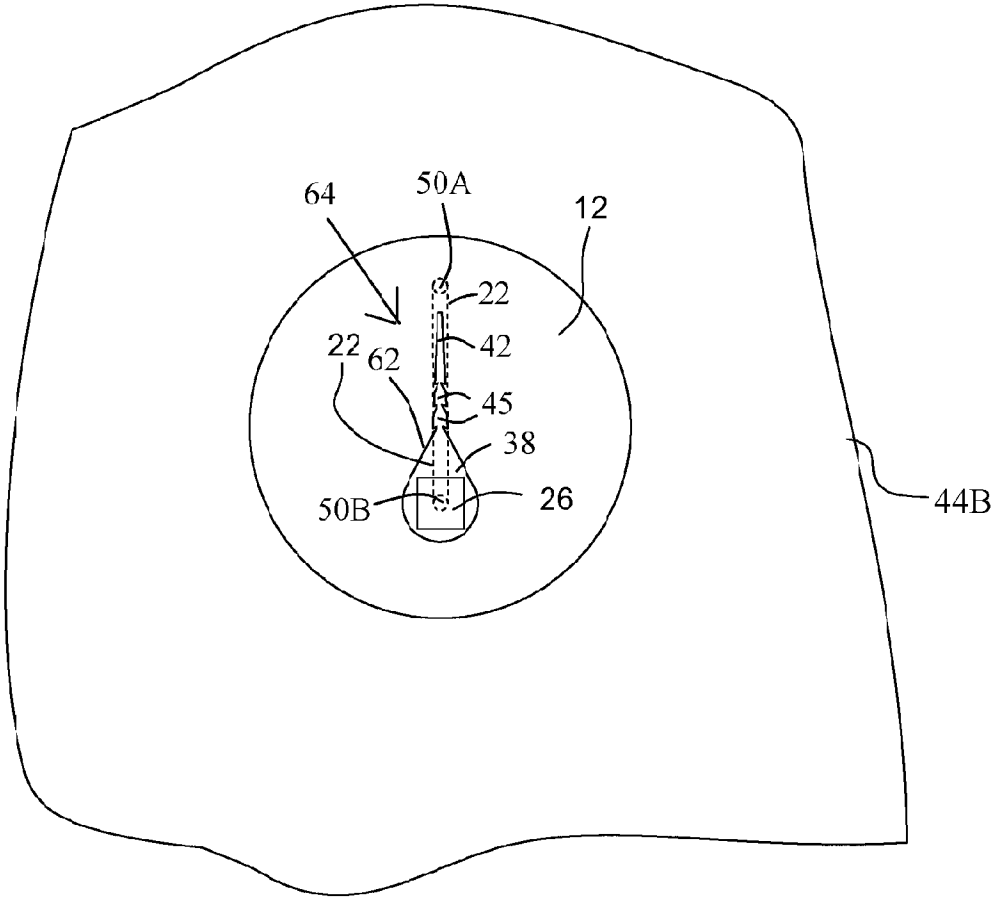
FIG. 7 is a front view of FIG. 5 after the fourth step.

FIG. 7 is a front view of FIG. 5 after the fourth step.

Slit 42 includes a plurality of one-way directed teeth 45.

Figure 8:
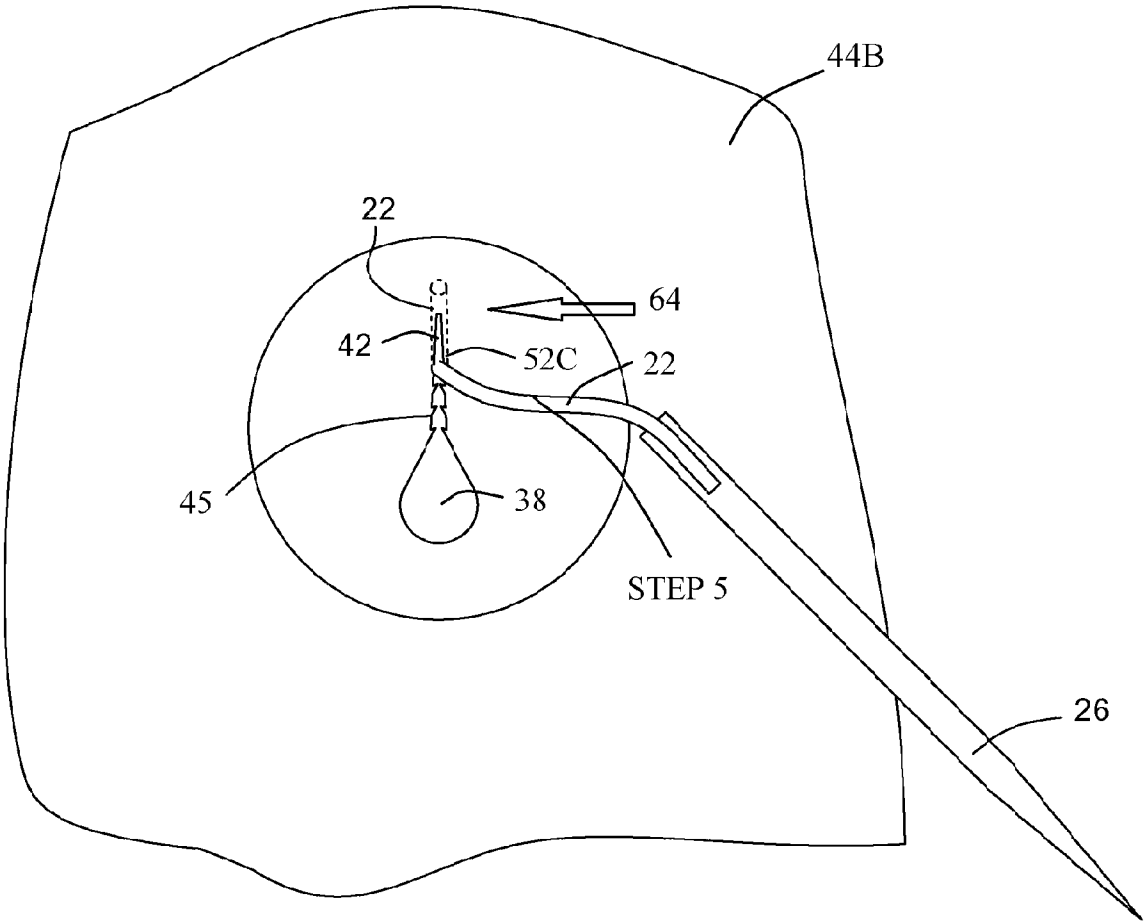
FIG. 8 is the front view of FIG. 6 at the fifth step.

FIG. 8 is the front view of FIG. 6 at the fifth step.

At the fifth step, the user further pulls needle 26, thus tensing string 22 and inserting it into and along slit 42 through a plurality of one-way directed teeth 45.

Slit 42 functions as a string snapping element 64 and is an element thereof, as slit 42 snaps string 22 at the tensed state. String snapping element 64 further includes a plurality of one-way directed teeth 45, accompanying the snapping.

Figure 9:
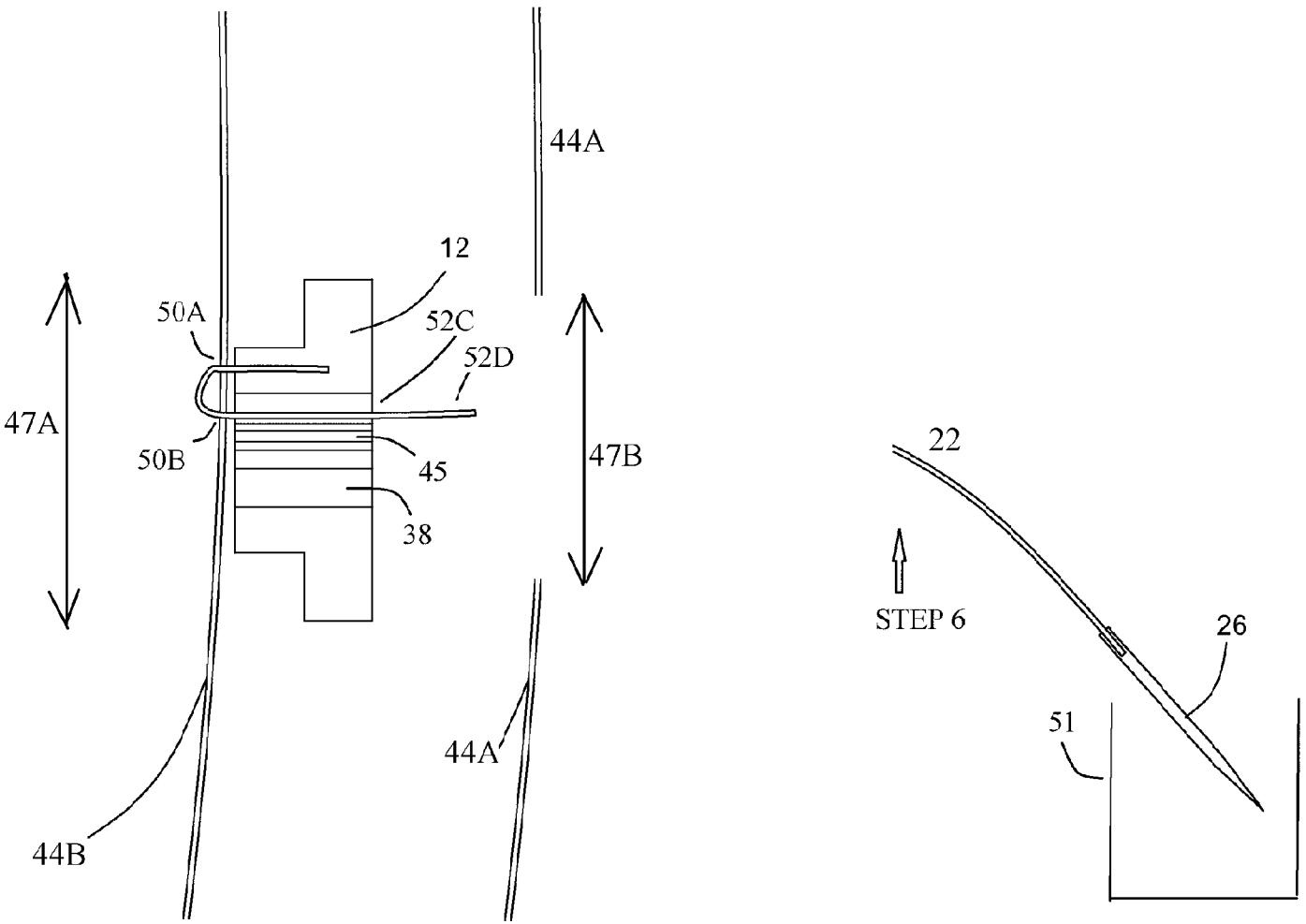
FIG. 9 is a side view of FIG. 6 at the sixth step.

FIG. 9 is a side view of FIG. 6 at the sixth step.

The length or diameter 47A of plate 12 is slightly smaller than a gap 68 provided by a cut of the other fabric 44A. Thus, diameter 47A of plate 12 is fitted for buttoning plate 12, being now a part of fabric 44B, to the cut of fabric 44A.

At the sixth step, the user cuts string 22 and puts string 22 and needle 26 into the garbage 51.

Thus, plate 12, string 22, and needle 26, fixed one to the other, constitute together an integrated object being buttoning apparatus 10, for attaching, without any button or any other element, plate 12 to fabric 44B for buttoning fabric 44B to fabric 44A.

Figure 10:
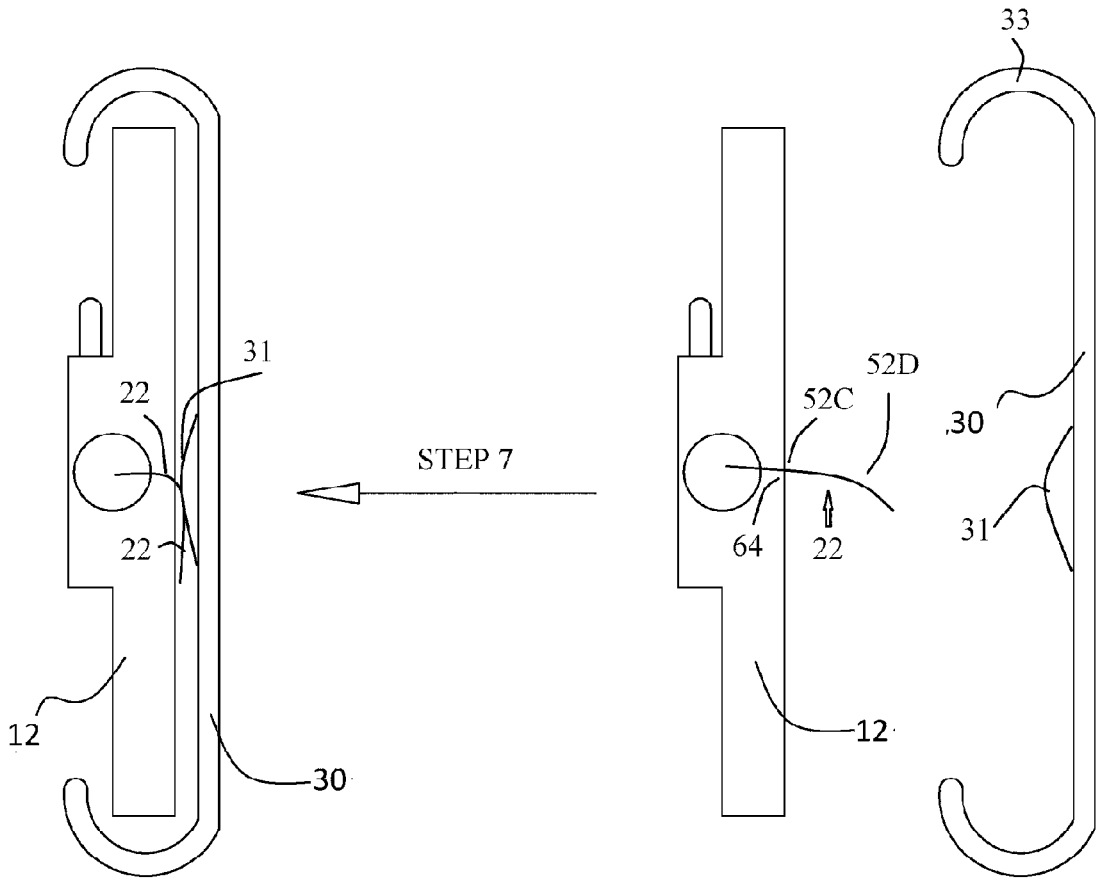
FIG. 10 depicts the seventh step.

FIG. 10 depicts the seventh step.

At the seventh step, the user may snap a cover 30 including snapping elements 33 to plate 12 for hiding plate 12 (as being larger) and tail 52D of string 22. Cover 30 may include a protrusion 31, for pressing string snapping element 64 of plate 12 together with pressing mid-portion 52C of string 22, thereby to strengthen the snapping of mid-portion 52C of string 22, and the tail 52D of string 22.

Figure 11:
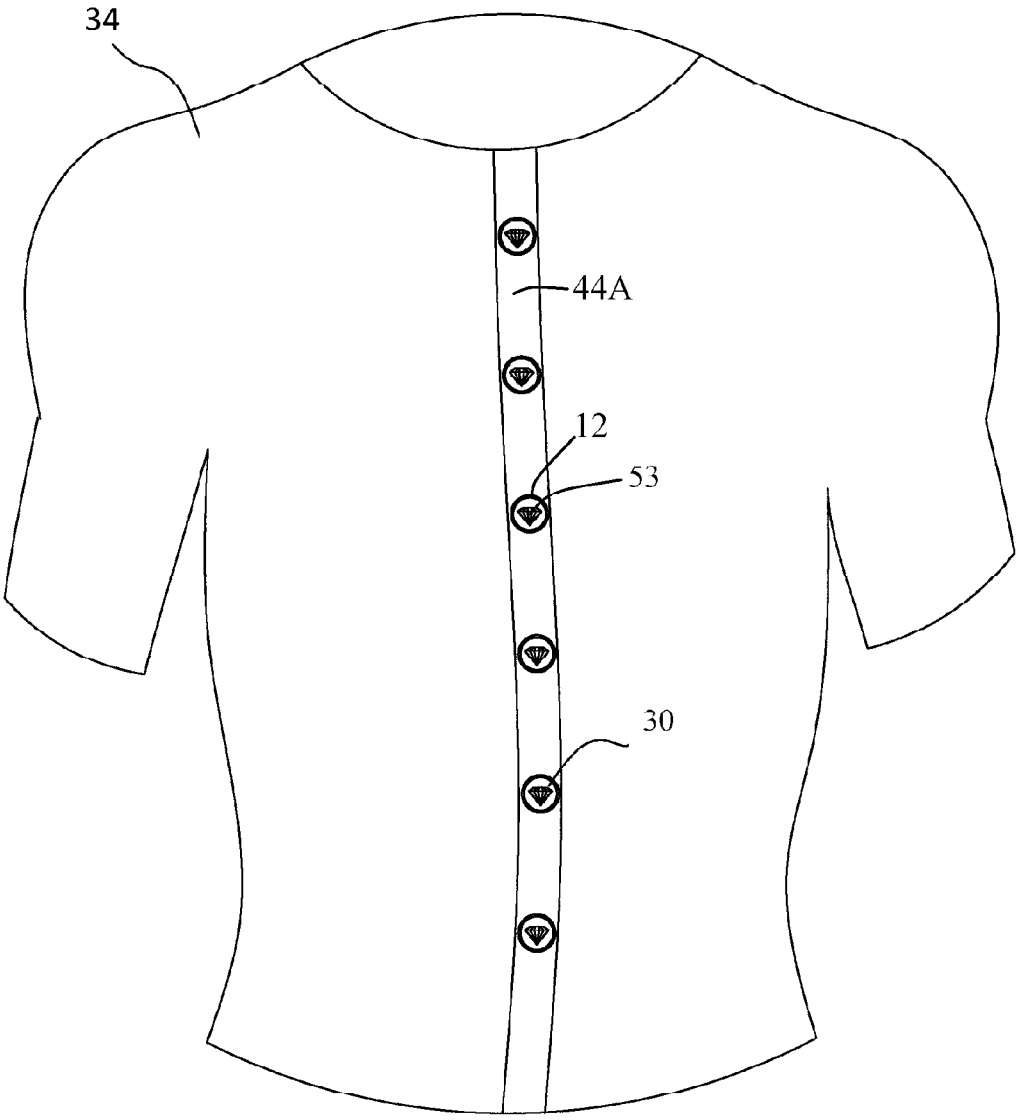
FIG. 11 depicts the plate attached to the fabric.

FIG. 11 depicts the plate attached to the fabric.

Cover 30 may include an ornamental design 53.

Figure 12:
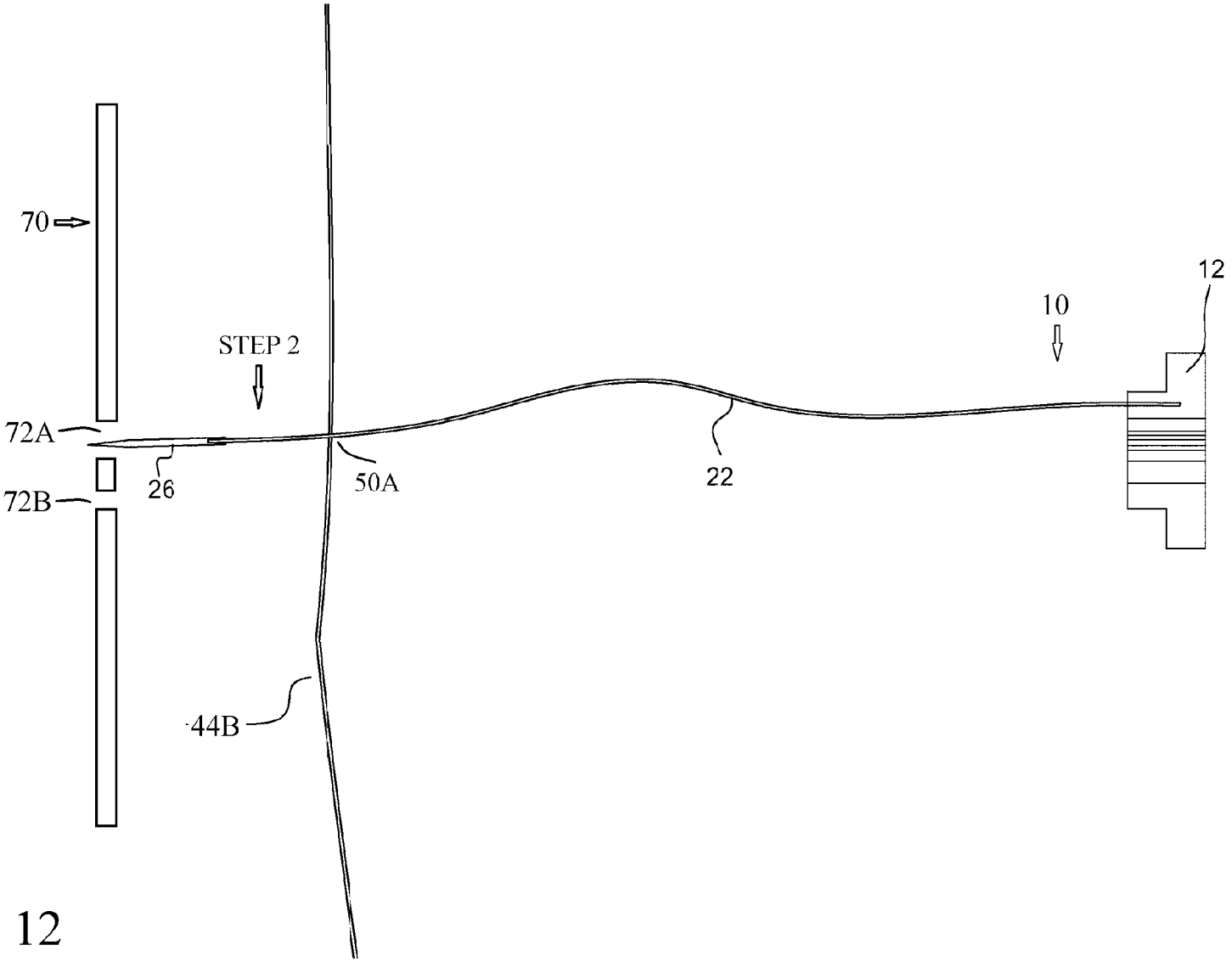
FIG. 12 depicts the second step of FIG. 4 for a buttoning apparatus according to another embodiment.

FIG. 12 depicts the second step of FIG. 4 for a buttoning apparatus according to another embodiment.

According to another embodiment, buttoning apparatus is intended for sewing a button 70 being larger than plate 12.

According to this embodiment, at the second step, the user threads needle 26 together with string 22 through point 50A of fabric 44B and from then into a hole 72A of button 70.

Figure 13:
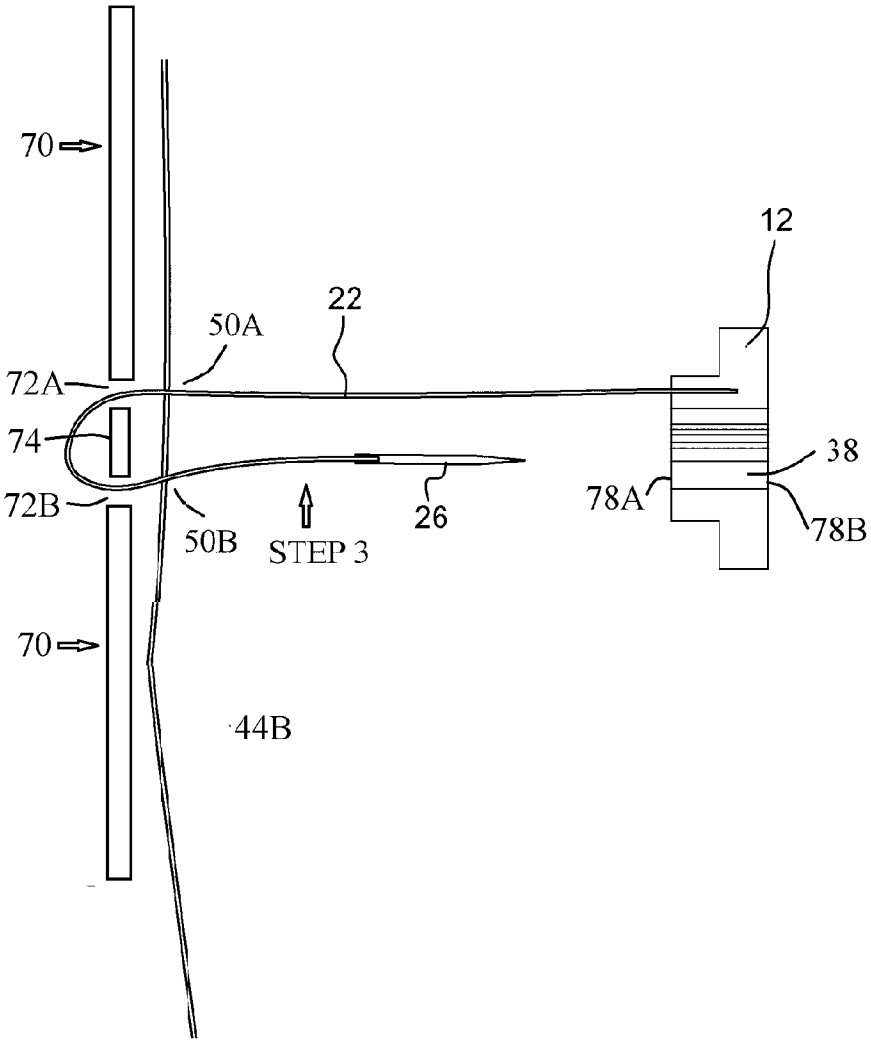
FIG. 13 depicts the third step of using the buttoning apparatus of FIG. 12.

FIG. 13 depicts the third step of using the buttoning apparatus of FIG. 12.

At the third step, the user threads needle 26 together with string 22 into a hole 27B of button 70, and from then back through point 50B of fabric 44B.

Thus, zone 75 of fabric 44B is secured by and between plate 12 and center 74 of button 70.

Figure 14:
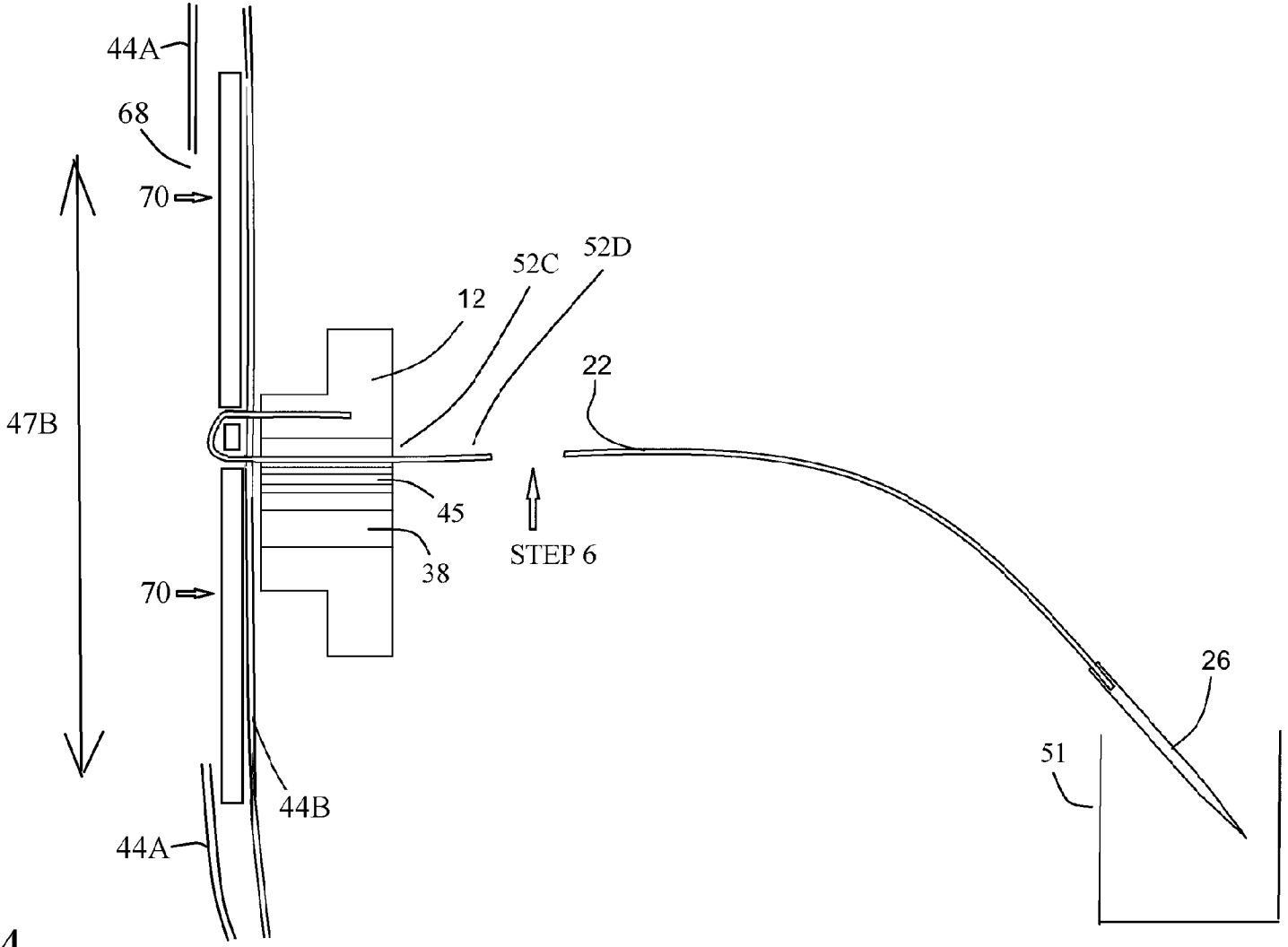
FIG. 14 is the side view of FIG. 9 for the buttoning apparatus of FIG. 12.

FIG. 14 is the side view of FIG. 9 for the buttoning apparatus of FIG. 12.

Thus, plate 12 together with string 22 and needle 26 have sewn button 70 to fabric 44B.

The length or diameter 47B of button 70 is slightly smaller than gap 68 provided by a cut of fabric 44A. Thus, diameter 47B of button 70 is fitted for buttoning button 70 to the cut of fabric 44A.

Thus, in one aspect, the invention is directed to a button sewing method, including the steps of:

providing a plate (12) including a needle (26) and a string (22), where a first end (52A) of the string (22) is fixed to the plate (12), and a second end (52B) of the string (22) is fixed to the needle (26), thereby the plate (12), the needle (26) and the string (22) being fixed one to the other, constitute together an integrated object;

providing a button (70) including at least a first (72A) and a second (72B) hole;

disposing a second fabric (44B) between the plate (12) and the button (70);

upon the disposing, threading the string (22) via the needle (26) into the second fabric (44B), and from then into the first hole (72A) of the button (70), and from then into the second hole (72B) of the button (70), and from then into the second fabric (44B), and from then onto the plate (12), thereby securing a zone (75) of the second fabric (44B) between the plate (12) and a center (74) of the button (70), the center being between holes 72A and 72B.

The plate (12) may include a slit (42), and the threading of the string (22) onto the plate (12) constitutes inserting the string (22) via the needle (26) through the slit (42).

In another aspect, the invention is directed to a fabric buttoning apparatus (10), including:

a plate (12), length (47A) thereof being slightly smaller than a gap (68) provided by a cut in a first fabric (44A), thereby the length (47A) of the plate being fitted for buttoning the plate (12) to the cut of the first fabric (44A);

a needle (26); and a string (22), a first end (52A) of the string (22) being fixed to the plate (12), and a second end (52B) of the string (22) being fixed to the needle (26), where the plate (12) includes a slit (42) crossing from a first side (78A) to a second side (78B) of the plate (12), the slit (42) for snapping a mid-portion (52C) of the string (22), thereby the plate (12), the needle (26) and the string (22) fixed one to the other, constitute together an integrated object being the buttoning apparatus (10), for attaching, without button 70 or any other element, the plate (12) to a second fabric (44B) for buttoning thereof to the first fabric (44A).

The slit (42) may include a plurality of one-way directed teeth.

The fabric buttoning apparatus (10) may further include a closed hole (38) crossing from the first side (78A) to the second side (78B) of the plate (12) and including a zone (62) narrowing from the hole (38) towards the slit (42).

The fabric buttoning apparatus (10) may further include a cover (30) including at least one snapping element (33), for snapping thereof to the plate (12) for covering thereof, thereby the cover (30) covers a portion of the string (12), the cover (30) being larger than the plate (12).

The cover (30) may include a protrusion (31), configured to press a tail (52D) of the string (22) to the plate (12) upon snapping the cover (30) to the plate (12), for securing the tail (52D) of the string (22) to the plate (12).

In the figures and/or description herein, the following reference numerals (Reference Signs List) have been mentioned:

numeral 10 denotes the buttoning apparatus according to one embodiment of the invention;

12: plate being the button;

18A,18B: rings for fixing end 52A of string 22;

22: string;

26: needle;

27A: wide end of needle 26;

27B: tip of needle 26;

30: cover;

31: protrusion;

33: snapping element of cover 30;

38: hole;

42: slit;

44A,44B: fabrics;

45: one-way teeth directed along plate 12 towards slit 42;

50A,50B: points of fabric 44B into which needle 26 is threaded;

51: garbage;

52A: zone of string 22 fixed to plate 12;

52B: zone of string 22 fixed to needle 26;

52C: mid-portion of string 22 snapped by string snapping element 64;

52D: tail of string 52D;

53: ornamental design of cover 30;

62: narrowing zone;

64: string snapping element;

The foregoing description and illustrations of the embodiments of the invention have been presented for the purpose of illustration, and are not intended to be exhaustive or to limit the invention to the above description in any form.

Any term that has been defined above and used in the claims, should be interpreted according to this definition.

The reference numbers in the claims are not a part of the claims, but rather used for facilitating the reading thereof. These reference numbers should not be interpreted as limiting the claims in any form.

What is claimed is:

1. A fabric buttoning apparatus, comprising:

a plate, length thereof being slightly smaller than a gap provided by a cut in a first fabric, thereby the length of the plate is fitted for buttoning the plate to the cut of the first fabric;

a needle; and a string, a first end of said string fixed to said plate, and a second end of said string being fixed to said needle, wherein said plate comprises a slit crossing from a first side to a second side of said plate, said slit for snapping a mid-portion of said string, and wherein said slit comprises a plurality of one-way directed teeth, and wherein said apparatus further comprises a closed hole crossing from said first side to said second side of said plate and comprising a zone narrowing from said hole towards said slit, thereby said plate, said needle and said string fixed one to the other, comprise together an integrated object being said buttoning apparatus, for attaching, without any other element, said plate to a second fabric for buttoning thereof to said first fabric.

2. A fabric buttoning apparatus, comprising:

a plate, length thereof being slightly smaller than a gap provided by a cut in a first fabric, thereby the length of the plate is fitted for buttoning the plate to the cut of the first fabric;

a needle; and a string, a first end of said string fixed to said plate, and a second end of said string being fixed to said needle, wherein said plate comprises a slit crossing from a first side to a second side of said plate, said slit for snapping a mid-portion of said string, wherein said slit comprises a plurality of one-way directed teeth, and wherein said apparatus further comprises a cover comprising at least one snapping element, for snapping thereof to said plate for covering thereof, thereby said cover covers a portion of said string, said cover being larger than said plate, and a protrusion configured to press a tail of said string to said plate upon snapping the cover to the plate, for securing said tail of said string to said plate, thereby said plate, said needle and said string fixed one to the other, comprise together an integrated object being said buttoning apparatus, for attaching, without any other element, said plate to a second fabric for buttoning thereof to said first fabric.

* * * * *